US006077058A

United States Patent [19]

Saitou et al.

[11] Patent Number: 6,077,058

[45] Date of Patent: Jun. 20, 2000

[54] ROTARY COMPRESSOR

[75] Inventors: Kenichi Saitou; Masanori Masuda; Hiromichi Ueno; Tsuyoshi Fukunaga; Katsumi Katou; Katsumi Kawahara; Takeyoshi Ookawa; Takashi Hirouchi, all of Osaka, Japan

[73] Assignee: Daikin Industries, Ltd., Osaka, Japan

[21] Appl. No.: 08/981,596

[22] PCT Filed: Sep. 13, 1996

[86] PCT No.: PCT/JP96/02658

§ 371 Date: Dec. 31, 1997

§ 102(e) Date: Dec. 31, 1997

[87] PCT Pub. No.: WO97/12148

PCT Pub. Date: Apr. 3, 1997

[30] Foreign Application Priority Data

Sep. 28, 1995 [JP] Japan ..... 7-250813

[51] Int. Cl.[7] ..... F01C 1/02

[52] U.S. Cl. ..... 418/66

[58] Field of Search ..... 418/66

[56] References Cited

U.S. PATENT DOCUMENTS

| | | | |
|---|---|---|---|
| 5,383,774 | 1/1995 | Toyama et al. | 418/66 |
| 5,564,916 | 10/1996 | Yamamoto et al. | 418/66 |
| 5,577,903 | 11/1996 | Yamamoto | 418/66 |
| 5,580,231 | 12/1996 | Yasui | 418/66 |
| 5,591,018 | 1/1997 | Takeuchi et al. | 417/366 |
| 5,641,279 | 6/1997 | Yamamoto | 418/66 |

FOREIGN PATENT DOCUMENTS

| | | |
|---|---|---|
| 2-139392 | 11/1990 | Japan . |
| 5-202874 | 8/1993 | Japan . |
| 6-147162 | 5/1994 | Japan . |
| 6-147164 | 5/1994 | Japan . |
| 6-317279 | 11/1994 | Japan . |
| 6-323273 | 11/1994 | Japan . |
| 13 11 78 | 1/1929 | Switzerland . |
| 567627 | 2/1945 | United Kingdom . |

*Primary Examiner*—Thomas Denion
*Assistant Examiner*—Theresa Trieu
*Attorney, Agent, or Firm*—Nixon Peabody LLP; Donald R. Studebaker

[57] ABSTRACT

When a driving shaft rotates, a piston (9) revolves around the driving shaft in a cylinder room (6*a*) with supported by a swing bush (32) as a supporting point through a blade (31). Discharge ports (22) are formed in a front head (7) and a rear head (8) respectively and are disposed to be located in the proximity of the blade (31) and to communicate with a high pressure room. A semicircular portion of the discharge port (22) overlaps with the swing bush (32) and the cylinder (6). A pair of upper and lower cut parts (41) are each formed by cutting away an outer peripheral edge of the swing bush (32) and an inner peripheral edge of the cylinder (6) which are overlapped with the discharge port (22).

5 Claims, 7 Drawing Sheets

ROTARY COMPRESSOR

TECHNICAL FIELD

This invention relates to a rotary compressor used for a refrigerating apparatus and the like, and in particular relates to a structure that a compressing element discharges a fluid.

BACKGROUND ART

There is a conventional rotary compressor as disclosed in, for example, Japanese Patent Application Laid-Open Gazette No. 6-147164, the rotary compressor comprising: a cylinder in which a cylinder room is formed; side housings respectively disposed on top and bottom surfaces of the cylinder to close the cylinder room; an annular piston which is disposed in the cylinder room and is rotatably fit at its inner periphery into a decentered shaft part of a driving shaft; a blade which is formed integrally with the piston and protrudes from the outer periphery of the piston to divide the cylinder room into a low pressure room communicating with an inlet port and a high pressure room communicating with a discharge port; and a swing bush swingably disposed in a bush hole which is formed in the cylinder and faces the cylinder room, the swing bush supporting the blade so that the blade is swingable and movable forward and backward.

When the driving shaft is rotated, the piston is revolved around the driving shaft in the cylinder room with supported by the swing bush as a supporting point through the blade, so that a fluid such as a refrigerant gas sucked from the inlet port at each revolution of the piston is compressed and discharged from the discharge port.

In the above-mentioned rotary compressor, the inlet and discharge ports are both formed in the cylinder and are open toward the cylinder room in a direction orthogonal to an axial direction of the driving shaft.

-Problem to be Solved-

In the above-mentioned rotary compressor, since the bush hole is formed in the cylinder, it is necessary to form the discharge port at a distance from the bush hole in order to prevent decrease in strength of the cylinder.

However, when the discharge port is formed at a distance from the bush hole, the discharge port is located apart from a position that the piston completes its one revolution. As a result, invalid power is produced during the time from the closing of the discharge valve to the completion of one revolution of the piston. This reduces efficiency of the compressor.

In view of the foregoing problem, the present invention has been made. An object of the present invention is to dispose a discharge port as close as possible to a position that the piston completes its one revolution so as to delay a revolution angle that a discharge valve completes the discharge of a fluid and reduce invalid power of the piston, thereby obtaining high compression efficiency.

DISCLOSURE OF INVENTION

To attain the above object, a measure taken in the present invention premises a rotary compressor which comprises: a cylinder (6) in which a cylinder room **(6*a*) is formed; side housings (7, 8) respectively disposed on both side surfaces in an axial direction of the cylinder (6) to close the cylinder room (6*a*); an annular piston (9) which is disposed in the cylinder room (6*a*) and is connected to a driving shaft (5) with decentered from the central axis of the driving shaft (5); a blade (31) which is formed integrally with the piston (9) and protrudes from the outer periphery of the piston (9) to divide the cylinder room (6*a*) into a low pressure room (34) communicating with an inlet port (21) and a high pressure room communicating with a discharge port (22); and a swing bush (32) which is swingably disposed in a support hole (24) formed in the cylinder (6) and supports the blade (31) so that the blade (31) is swingable and movable forward and backward, rotation of the driving shaft (5) causing revolution of the piston (9) around the driving shaft (5) in the cylinder room (6*a*) through the blade (31) thereby compressing a fluid in the cylinder room (6*a*)**.

Further, the discharge port (22) is formed in at least one of the side housings (7) and is disposed to be located in the proximity of the blade (31) and to communicate with the high pressure room (35). In addition, the rotary compressor further comprises a guide part (4A) for guiding a high-pressure fluid in the high pressure room (35) to the discharge port (22).

In this invention, when the driving shaft (5) rotates, the piston (9) is revolved around the driving shaft (5) in the cylinder room **(6*a*) with supported by the swing bush (32) as a supporting point through the blade (31), thereby compressing a fluid. At this time, since the discharge port (22) is disposed in at least one of the side housings (7) and is disposed to be located in the proximity of the blade (31) and to communicate with the high pressure room (35), the fluid in the high pressure room (35)** is compressed up to a highly pressurized state.

Further, the high-pressure fluid in the high pressure room (35) is guided by the guide part (4A) to flow into the discharge port (22), so that the high-pressure fluid is smoothly discharged from the discharge port (22).

Meanwhile, a revolution distance from the closing of the discharge valve (23) to the completion of one revolution of the piston (9) becomes shorter so that invalid power is reduced.

According to the present invention, since the discharge port (22) can be placed as close as possible to a position that the piston (9) completes its one revolution, a revolution angle that the discharge valve (23) completes the discharge of the fluid can be delayed. As a result, invalid power of the piston (9) after the closing of the discharge valve (23) can be reduced. This improves the efficiency of the compressor.

Moreover, since the high-pressure fluid in the high pressure room (35) flows into the discharge port (22) along the guide part (4A), flow resistance can be reduced thereby improving compression efficiency.

In another invention, it is preferable that the discharge port (22) is disposed to partially overlap with the cylinder (6) and the swing bush (32) and that the guide part (4A) is composed of a cut part (41) formed by cutting away an inner peripheral edge of the cylinder (6) and an outer peripheral edge of the swing bush (32) which are overlapped with the discharge port (22).

In this invention, since a fluid in the high pressure room (35) moves along the inner periphery of the cylinder (6), the fluid flows from the inner periphery of the cylinder (6) into the cut part (41), then flows from the cut part (41) into the discharge port (22) and is discharged from the discharge port (22).

Further, a load working on the swing bush (32) from the high pressure room (35) side is stopped by the cylinder (6) through the swing bush (32) on the low pressure room (34) side.

Thus, since the cut part (41) is formed along the flow of the fluid of the high pressure room (35), flow resistance of the fluid can be securely reduced. This securely improves compression efficiency.

In addition, since a load from the high pressure room (35) side works on the swing bush (32) through the cut part (41) and is stopped by the swing bush (32) on the low pressure room (34) side, an ill effect due to the cut part (41) can be securely avoided.

Further, in still another invention, the discharge port (22) may be disposed to partially overlap with the cylinder (6) and the swing bush (32), while the guide part (4A) may be composed of a cut part (51) formed by cutting away only an inner peripheral edge of the cylinder (6) with which the discharge port (22) overlaps.

In this invention, the fluid in the high pressure room (35) flows into the discharge port (22) along the cut part (51) formed in the cylinder (6) and is discharged from the discharge port (22).

Thus, since the cut part (51) is formed only in the cylinder (6), this eliminates the need for forming a cut part in the swing bush (32), thereby facilitating the formation of the cut part (51) and reducing production cost.

In still another invention, the discharge port (22) may be disposed to at least partially overlap with the piston (9) on the way of revolution of the piston (9), while the guide part (4A) may be composed of a cut part (61) formed by cutting away an outer peripheral edge of the piston (9) which corresponds to an overlapped portion of the discharge port (22) with the piston (9).

In this invention, since the piston (9) does not rotate on its axis, the discharge port (22) and the cut part (61) overlap with each other during discharge of the fluid, so that the fluid in the high pressure room (35) flows into the discharge port (22) along the cut part (61) of the piston (9) and is then discharged from the discharge port (22).

Thus, since the discharge port (22) and the cut part (61) can securely overlap with each other during discharge of the fluid, this secures smooth discharge of the fluid flowing into the discharge port (22).

Further, in still another invention, the discharge port (22) may be disposed to overlap at one part with the cylinder (6) and the swing bush (32) and to overlap at another part with the piston (9) on the way of revolution of the piston (9), while the guide part (4A) may be composed of a cut part (71) formed by cutting away an inner peripheral edge of the cylinder (6) and an outer peripheral edge of the swing bush (32) which are overlapped with the discharge port (22) and cutting away an outer peripheral edge of the piston (9) which corresponds to an overlapped portion of the discharge port (22) with the piston (9).

In this invention, the fluid in the high pressure room (35) flows into the discharge port (22) along the cut part (71) which is formed in the cylinder (6), the swing bush (32) and the piston (9) and is then discharged from the discharge port (22).

Thus, since the fluid in the high pressure room (35) can be discharged with efficiency, this further improves efficiency of the compressor.

BEST MODE FOR CARRYING OUT THE INVENTION

Below, description is made about embodiments of the present invention with reference to the drawings.

-First Embodiment-

Figure 4:
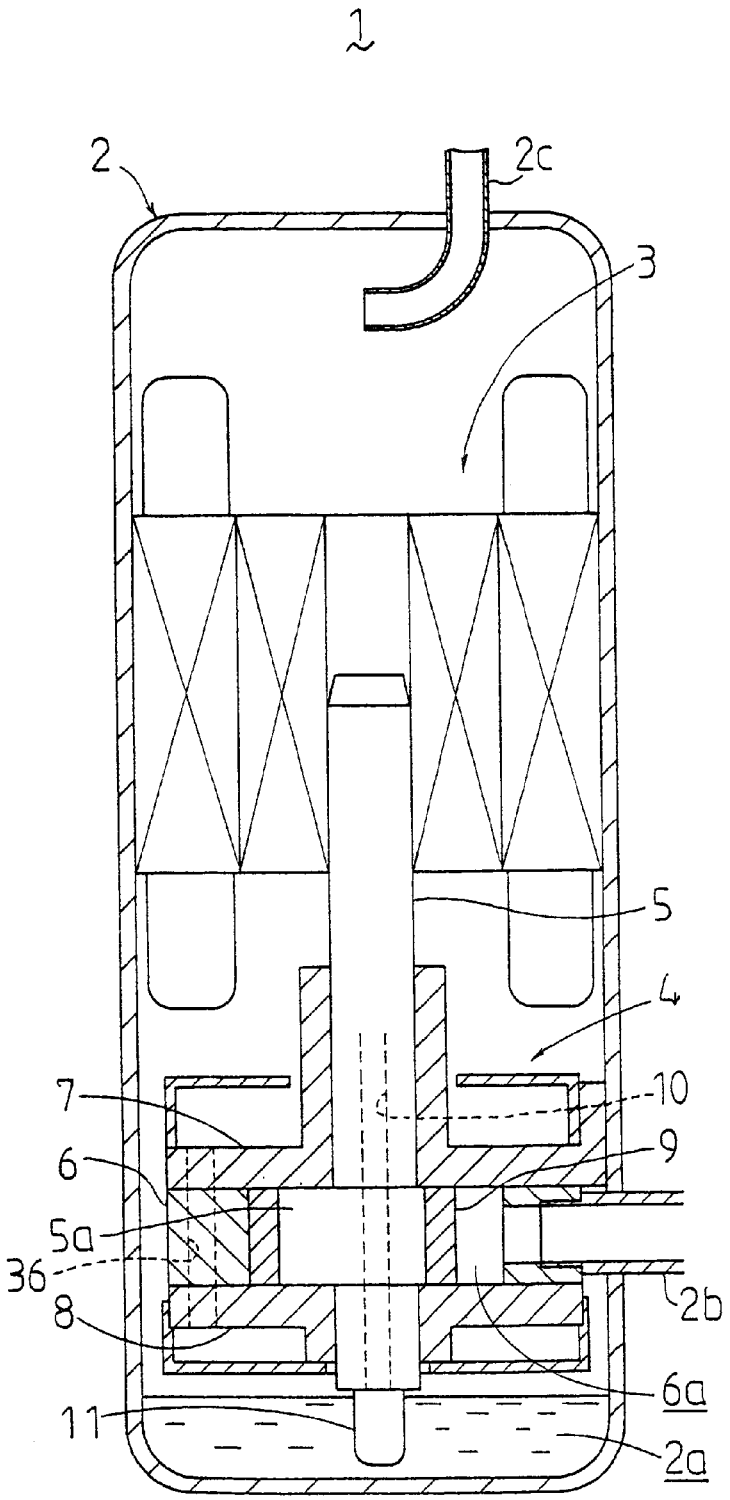
FIG. 4 is a longitudinal cross-sectional view of a rotary compressor of the first embodiment.

FIG. 4 shows the entire structure of a rotary compressor (1) according to a first embodiment of the present invention.

The rotary compressor (1) is provided with a motor (3) disposed at an upper portion within an enclosed casing (2) and a compressing element (4) located below the motor (3), and is so composed that the compressing element (4) is driven into rotation by rotation of a driving shaft (5) extending from the motor (3).

The compressing element (4) includes a cylinder (6) having a cylinder room **(6*a*) inside thereof, a front head (7) and a rear head (8) which are respectively disposed at upper and lower openings of the cylinder (6) and form side housings for closing the upper and lower openings, and a piston (9) rotatably disposed inside the cylinder room (6*a*). The driving shaft (5) is supported at its lower portion by bearing parts provided at both the heads (7, 8)**.

Figure 3:
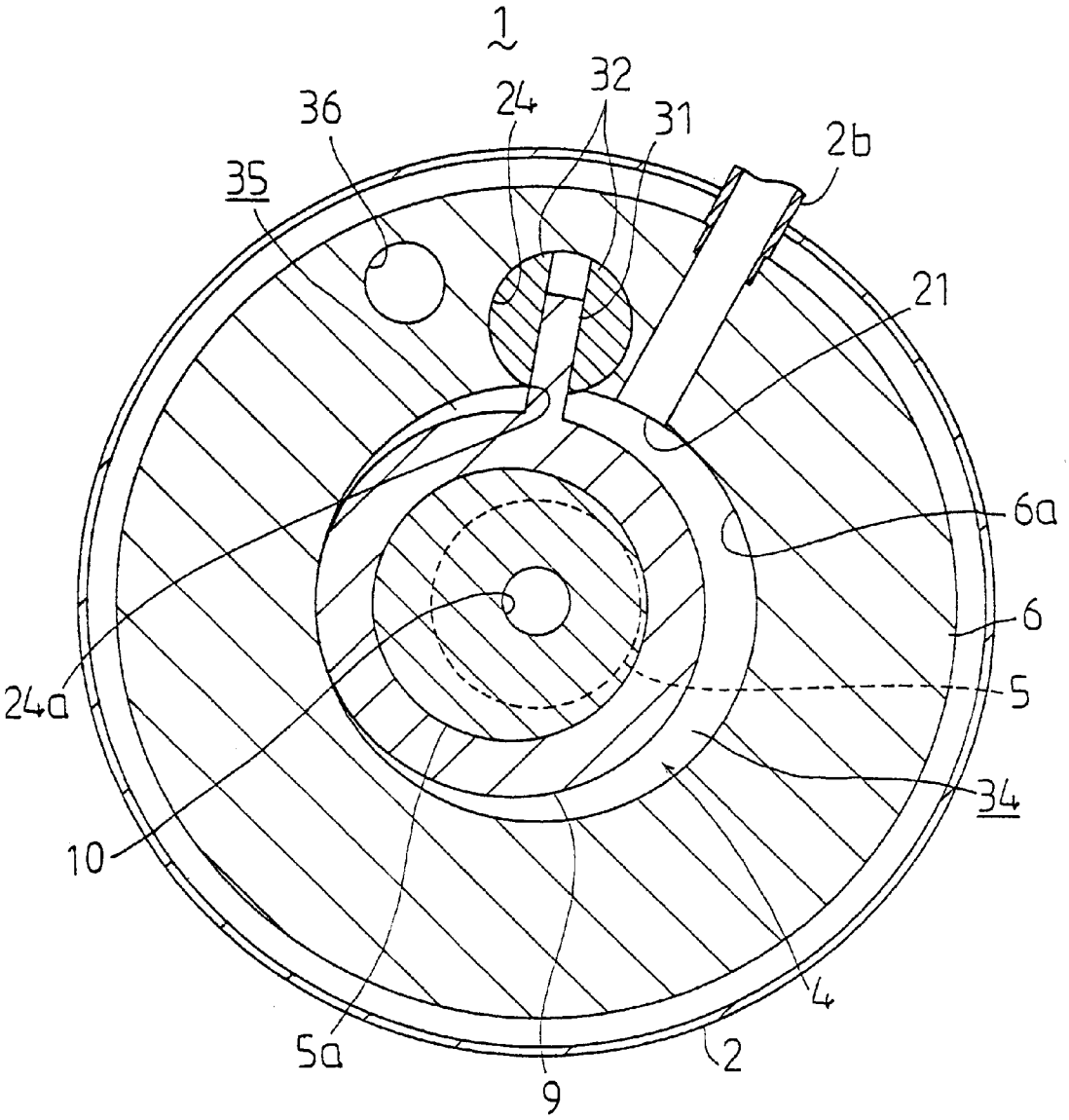
FIG. 3 is a cross-sectional plan view of a compressing element cut in the vicinity of a decentered shaft part of the first embodiment.

As shown in FIG. 3, the inner periphery of the cylinder room **(6*a*) is formed in the shape of a circle in section, while the piston (9) is formed annularly. A decentered shaft part (5*a*) of the driving shaft is rotatably fit into the inner periphery of the piston (9). An axis of the decentered shaft part (5*a*) is decentered by a fixed amount from the central axis of the driving shaft (5). When the driving shaft (5) rotates, the piston (9) is not rotated on its axis but only revolved around the driving shaft (5). At this time, the piston (9) revolves along the outer periphery of the cylinder room (6*a*) in a state that one point of the outer periphery of the piston (9) is contacted with the outer periphery of the cylinder room (6*a*)** or located in the vicinity of it.

On the central axis side of the driving shaft (5), an oil supply path (10) is provided which is open toward an oil reservoir **(2*a*) located at the bottom of the casing (2). The oil supply path (10) is provided with a pump element (11) located on its inlet side, and an intermediate outlet which is open at a surface where the decentered shaft part (5*a*) slides on the piston (9), that is, in the cylinder room (6*a*). The oil supply path (10) supplies a lubricating oil lifted from the oil reservoir (2*a*) by the pump element (11) into the cylinder room (6*a*)** through the intermediate outlet.

Further, the cylinder (6) is provided with an inlet port (21) which is open at the outer periphery of the cylinder room (6*a*). The inlet port (21) is connected to an inlet pipe (2*b*) extending from the outside of the enclosed casing (2).

Figure 2:
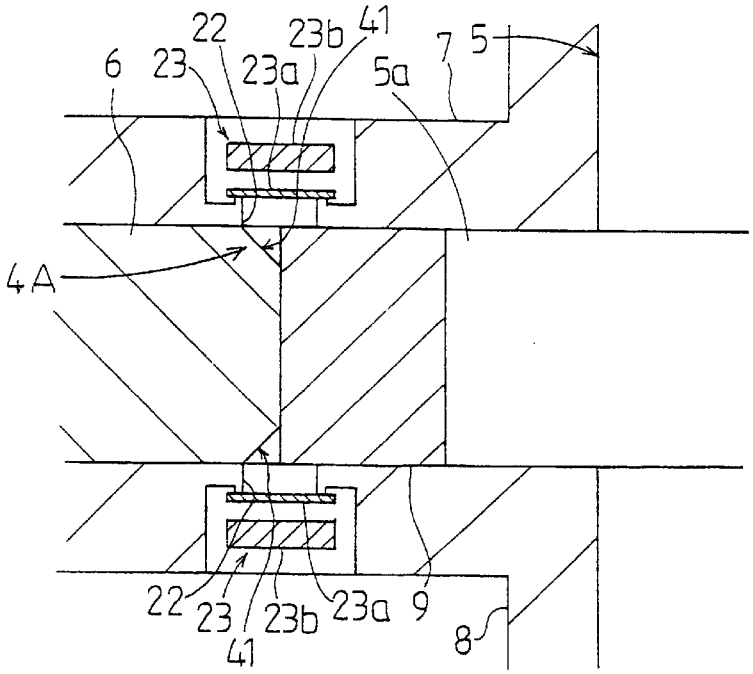
FIG. 2 is a longitudinal cross-sectional view of the necessary part in the vicinity of the cut part, wherein the piston is at a position that its one revolution is completed.

As shown in FIG. 2, the front head (7) and the rear head (8) are provided with circular discharge ports (22, 22) respectively which are open at top and bottom walls of the cylinder room (6*a*) respectively. Each of the discharge ports (22) is provided with a discharge valve (23) which opens when a pressure in the cylinder room (6*a*), more specifically, a pressure in the below-mentioned high pressure room (35) rises to a set value or more.

Each of the discharge valves (23) has a valve element (23*a*) for opening and closing the discharge port (22) and a valve stopper (23*b*) which contacts the valve element (23*a*) to control the opening thereof when the valve element (23*a*) is opened by a set amount or more.

In the cylinder (6), a column-like bush hole (24) as a support hole is formed which passes through the cylinder (6) in an axial direction at a position between the inlet port (21) and the discharge ports (22). The bush hole (24) has an opening (24*a*) which is open toward the cylinder room (6*a*). As shown in FIG. 4, the enclosed casing (2) is connected at an upper portion thereof to an external discharge pipe (2*c*).

Together with the piston (9), a blade (31) which protrudes and extends from the outer periphery of the piston (9) in its radial direction is integrally formed. The blade (31) is formed into one piece with the piston (9) or is formed by a separate member in such a manner that the blade (31) is joined to the piston (9) by male-female fit or is bonded to the piston (9) through an adhesive agent or the like.

The blade (31) is inserted at its end into the bush hole (24). In the bush hole (24), a pair of swing bushes (32, 32) each having the shape of a semicircle in section are swingably disposed. Both the swing bushes (32, 32) are arranged so as to interpose the end of the blade (31) therebetween and allow the blade (31) to move forward and backward in the bush hole (24), and are composed so as to swing in the bush hole (24) together with the blade (31).

The blade (31) divides the cylinder room (6*a*) located between the inner periphery of the cylinder (6) and the outer periphery of the piston (9) into a low pressure room (34) communicating with the inlet port (21) and a high pressure room (35) communicating with each of the discharge ports (22). The piston (9) revolves along the outer periphery of the cylinder room (6*a*) with supported by the swing bush (32) as a supporting point through the blade (31) formed integrally with the piston (9). The piston (9) compresses a fluid such as a refrigerant gas sucked from the inlet port (22) at every one revolution and discharges it from each of the discharge ports (22).

In the vicinity of the discharge ports (22), a through hole (36) which passes through both the heads (7, 8) and the cylinder (6) is formed. The fluid discharged from the lower discharge port (22) is introduced to the upper side, that is, above the compressing element (4) via the through hole (36).

Figure 1:
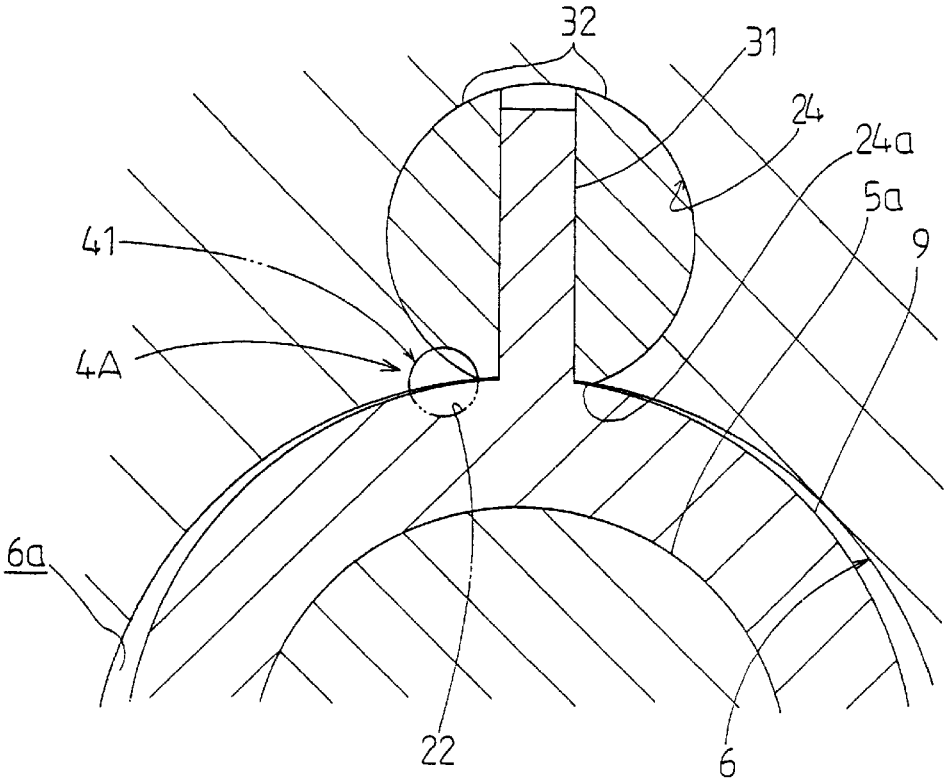
FIG. 1 is a cross-sectional plan view of a necessary part in the vicinity of a cut part according to a first embodiment of the present invention, wherein a piston is at a position that its one revolution is completed.

As one of features of the present invention, which is shown in FIG. 1, the discharge ports (22) are formed in the front head (7) and the rear head (8) respectively, and are disposed to be located in the proximity of the blade (31) and to communicate with the high pressure room (35). More specifically, each of the discharge ports (22) is disposed so that its semicircular portion overlaps with an outer peripheral edge of the swing bush (32) on the high pressure room (35) side from the blade (31) and an inner peripheral edge of the cylinder (6) adjacent to the outer peripheral edge of the swing bush (32).

In the swing bush (32) and the cylinder (6), a guide part (4A) is provided for guiding a high-pressure fluid in the high pressure room (35) into the discharge port (22). The guide part (4A) is composed of a pair of upper and lower cut parts (41, 41) formed by cutting away respective overlapped portions of the discharge ports (22) with upper and lower outer peripheral edges of the swing bush (32) and upper and lower inner peripheral edges of the cylinder (6). Each of the cut parts (41) has the shape of a semi-cone that its periphery increasingly extends as it becomes close to the discharge port (22).

-Compressing Operation-

Next, description is made about a compressing operation of the rotary compressor (1) of the first embodiment.

First, when the driving shaft (5) is drivingly rotated, the piston (9) swings around the center of the bush hole (24) as a supporting point, that is, makes only a revolving movement since the piston (9) is formed integrally with the blade (31). In other words, under a condition that a state that the blade (31) sinks most profoundly into the bush hole (24) is set to a revolution angle (swing angle) of 0 degree, the piston (9) revolves along the inner periphery of the cylinder (6). During one revolution of the piston (9), the fluid flowing from the inlet port (21) into the cylinder room (6*a*) is compressed and is then discharged from the discharge port (22) into the enclosed casing (2).

During the above compressing operation, the fluid in the high pressure room (35) is compressed up to a highly pressurized state, since the discharge port (22) is provided at both the heads (7, 8) and is arranged in the proximity of the blade (31).

Further, the high-pressure fluid in the high pressure room (35) is guided into the cut part (41) and flows into the discharge port (22), so that the high-pressure fluid is smoothly discharged from the discharge port (22). In particular, since the fluid in the high pressure room (35) moves along the inner periphery of the cylinder (6), the fluid flows along the cut part (41) from the inner periphery of the cylinder (6), flows into the discharge port (22) and is discharged from the discharge port (22).

-Effects of First Embodiment-

According to the first embodiment, the discharge port (22) can be disposed as close as possible to a position that one revolution of the piston (9) is completed (position of the piston shown in FIG. 1 whose revolution angle is 360 degrees), a revolution angle that the discharge valve (23) completes the discharge of a fluid can be delayed. As a result, a revolution distance from the closing of the discharge valve (23) to the completion of one revolution of the piston (9) can be shortened, so that invalid power after the closing of the discharge valve (23) is reduced. This enhances efficiency of the compressor.

Furthermore, since the high-pressure fluid in the high pressure room (35) flows into the discharge port (22) along the cut part (41), flow resistance can be reduced thereby improving compression efficiency.

In particular, since the cut part (41) is formed along the flow of the fluid in the high pressure room (35), flow resistance of the fluid can be securely reduced. This secures improvement of the compression efficiency.

In addition, since a load from the high pressure room (35) side works on the swing bush (32) through the cut part (41) and is stopped by the swing bush (32) on the low pressure room (34) side, an ill effect due to the cut part (41) can be securely avoided.

-Modification of First Embodiment-

Figure 5:
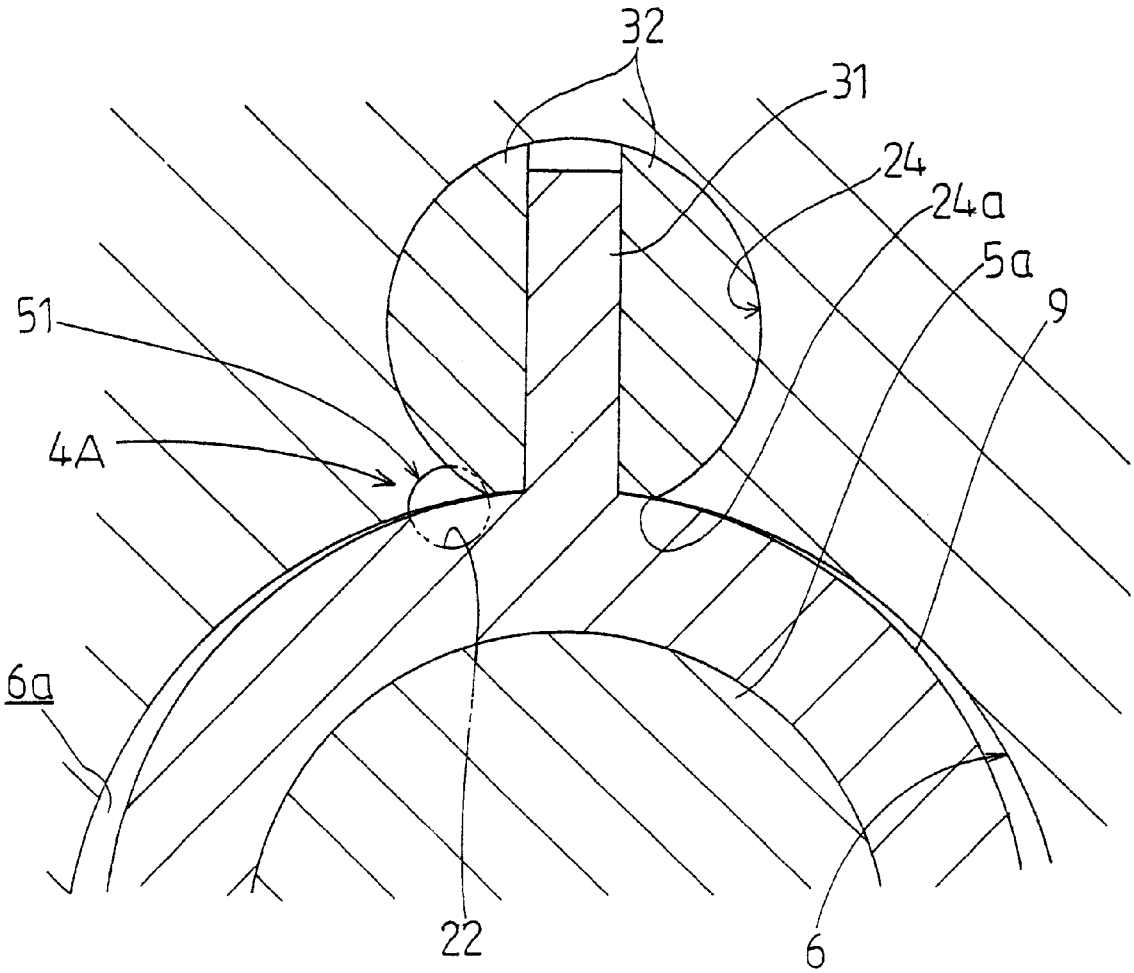
FIG. 5 is a view which shows a modification of the first embodiment and corresponds to FIG. 1.

In the above-mentioned embodiment, the cut part (41) is formed across both of the swing bush (32) and the cylinder (6). However, as shown in FIG. 5, a pair of upper and lower cut parts (51) may be formed only in the cylinder (6).

More specifically, when an overlapped portion of the discharge port (22) with the cylinder (6) is larger than an overlapped portion of the discharge port (22) with the swing bush (32), for example, when the overlapped portion of the discharge port (22) with the cylinder (6) occupies 70% to 95% of the entire overlapped portion of the discharge port (22), a pair of cut parts (51) may be formed only at upper and lower inner peripheral edges of the cylinder (6).

In this case, a fluid in the high pressure room (35) flows along the cut parts (51) and is then smoothly discharged from the discharge ports (22).

Thus, since the cut parts (51) are formed only in the cylinder (6), this eliminates the need for forming a cut part in the swing bush (32). Hence, the formation of the cut parts (51) can be facilitated and production cost can be reduced.

-Second Embodiment-

Figure 6:
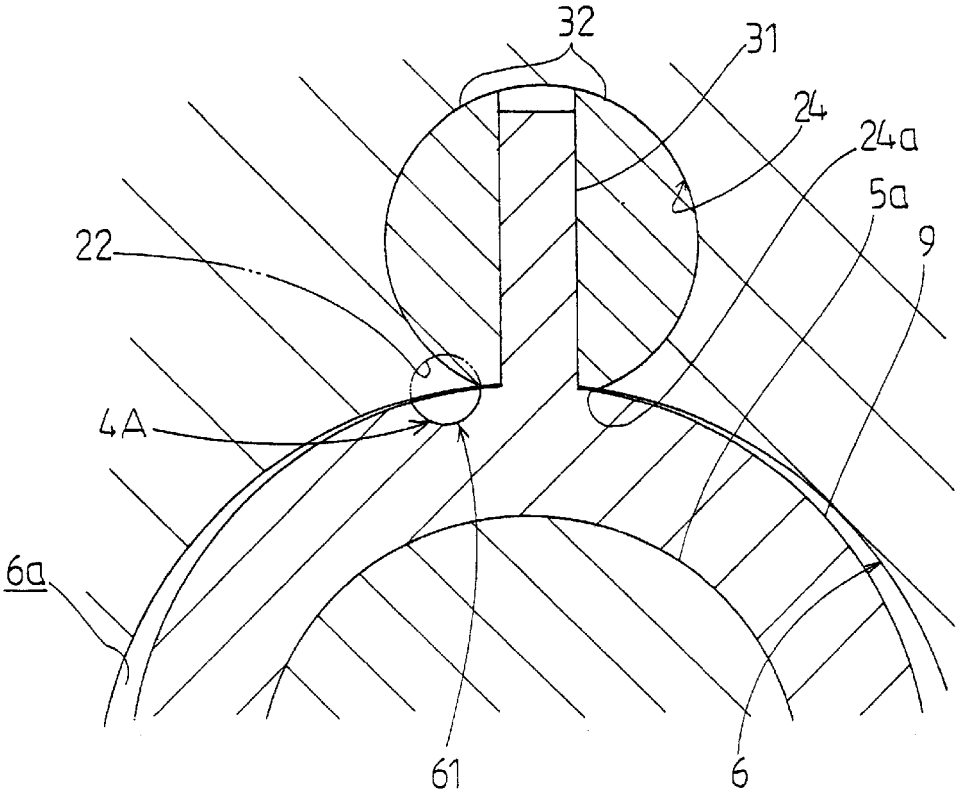
FIG. 6 is a view which shows a second embodiment of the present invention and corresponds to FIG. 1.
Figure 7:
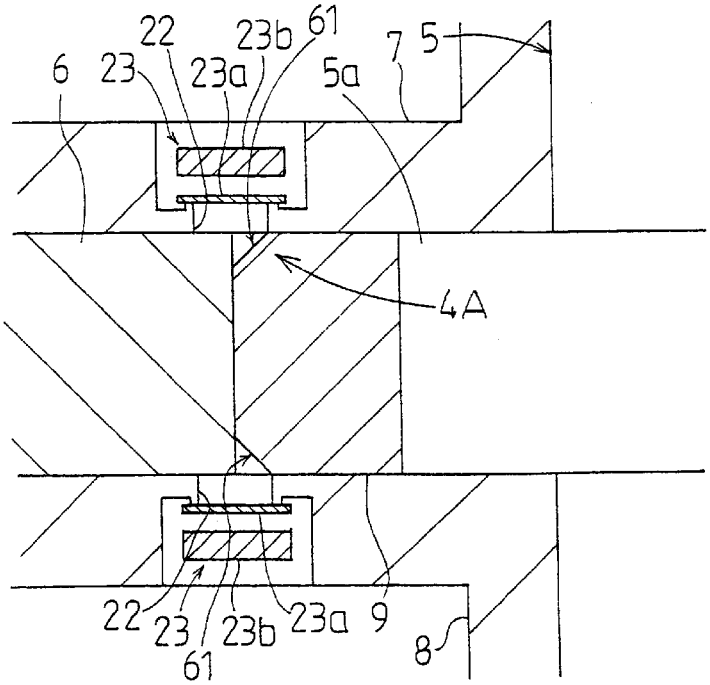
FIG. 7 is a view which shows the second embodiment and corresponds to FIG. 2.

Next, description is made about a second embodiment of the present invention with reference to FIGS. 6 and 7.

In this second embodiment, positions where cut parts are provided are different from those of the first embodiment. That is, the guide part (4A) is composed of a pair of cut parts (61) formed in the piston (9).

More specifically, as shown in FIGS. 6 and 7, each of the discharge ports (22) substantially overlaps at its semicircular portion open toward the high pressure room (35) with the piston (9) when the piston (9) is at a position that its one revolution is completed.

The cut parts (61) are each formed by cutting away an outer peripheral edge of the piston (9) which corresponds to an overlapped portion of the discharge port (22) with the piston (9).

Since other structures except the cut parts (61) are the same as in the first embodiment, same parts refer to same reference numerals and detailed description is not made.

According to the present embodiment, as in the first embodiment, the discharge ports (22) can be disposed as close as possible to a position that the piston (9) completes its one revolution. Hence, a revolution angle that the discharge valve (23) completes the discharge of a fluid can be delayed and invalid power of the piston (9) can be effectively reduced, thereby accomplishing high compression efficiency.

Further, since the high-pressure fluid in the high pressure room (35) flows into the discharge port (22) along the cut parts (61), flow resistance can be reduced thereby improving compression efficiency.

In particular, since the piston (9) does not rotate on its axis, the discharge port (22) and the cut part (61) can securely overlap with each other during discharge of the fluid. This secures smooth discharge of the fluid flowing into the discharge port (22).

-Third Embodiment-

Figure 8:
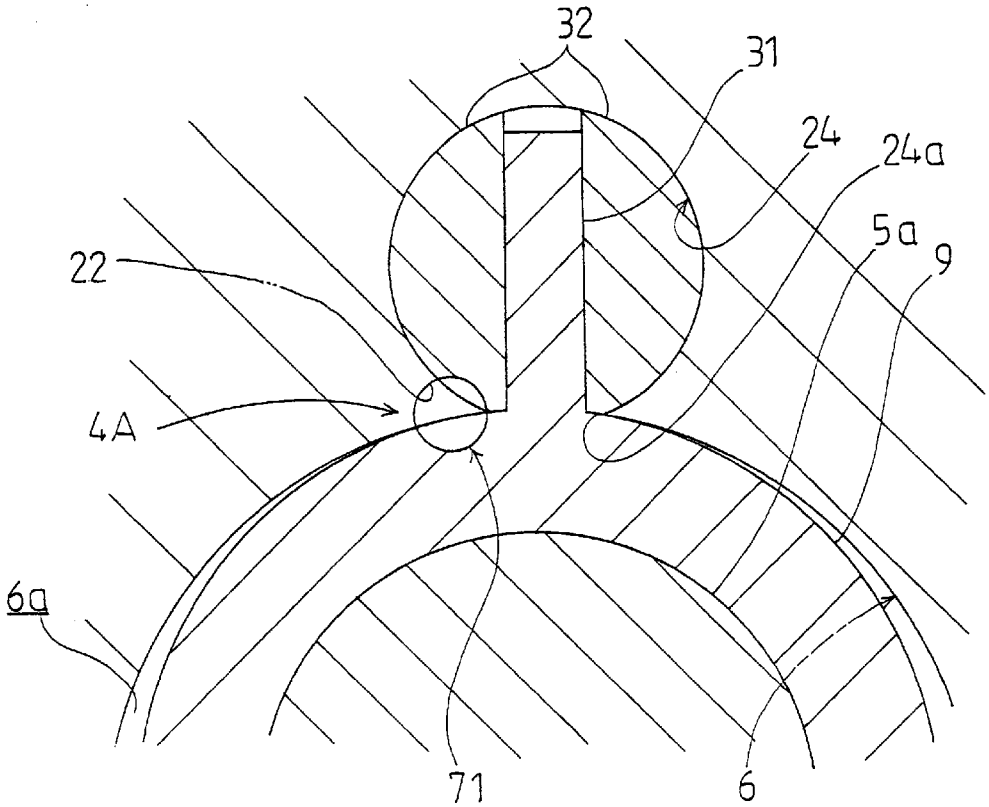
FIG. 8 is a view which shows a third embodiment of the present invention and corresponds to FIG. 1.
Figure 9:
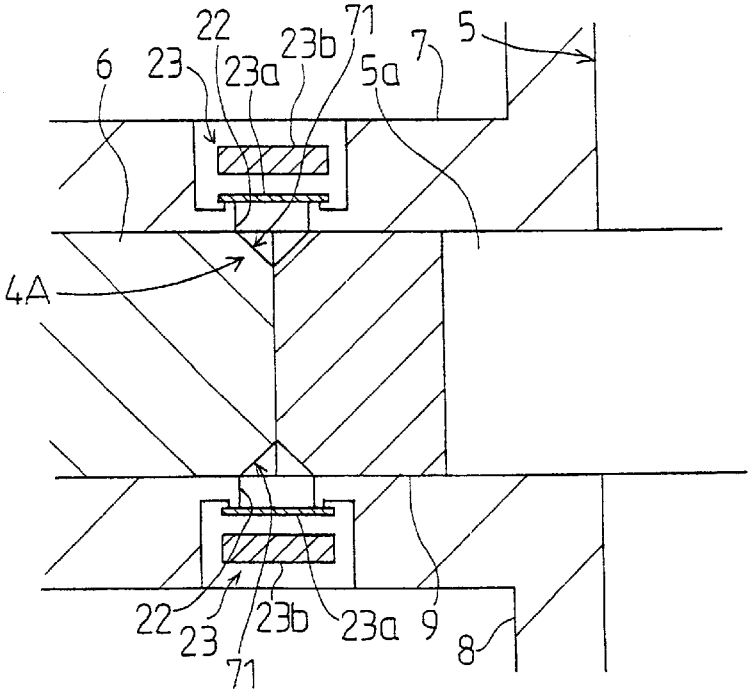
FIG. 9 is a view which shows the third embodiment and corresponds to FIG. 2.

Next, description is made about a third embodiment of the present invention with reference to FIGS. 8 and 9.

In this third embodiment, positions and shapes of cut parts are different from those of the first embodiment. That is, the guide part (4A) is composed of a pair of cut parts (71) formed across the cylinder (6), the swing bush (32) and the piston (9). In other words, this embodiment is a combination of the first embodiment shown in FIGS. 1 and 2 and the second embodiment shown in FIGS. 6 and 7.

More specifically, as shown in FIGS. 8 and 9, each of the discharge ports (22) overlaps at its one semicircular portion with the swing bush (32) on the high pressure room (35) side and the cylinder (6) and substantially overlaps at the other semicircular portion open toward the high pressure room (35) with the piston (9) when the piston (9) is at a position that its one revolution is completed.

The cut parts (71) are each formed by cutting away an outer peripheral edge of the swing bush (32), an inner peripheral edge of the cylinder (6) and an outer peripheral edge of the piston (9) in the shape of a cone.

Since other structures except the cut parts (71) are the same as in the first embodiment, same parts refer to same reference numerals and detailed description is not made.

According to the present embodiment, as in the first and second embodiments, the discharge ports (22) can be disposed as close as possible to a position that the piston (9) completes its one revolution. Hence, a revolution angle that the discharge valve (23) completes the discharge of a fluid can be delayed and invalid power of the piston (9) can be effectively reduced, thereby accomplishing high compression efficiency.

Further, since the high-pressure fluid in the high pressure room (35) flows into the discharge port (22) along the cut parts (71), flow resistance can be reduced thereby improving compression efficiency.

Furthermore, since the piston (9) does not rotate on its axis, the discharge port (22) and the cut part (71) of the piston (9) can securely overlap with each other during discharge of the fluid. This secures smooth discharge of the fluid flowing into the discharge port (22).

-Other Embodiments-

The present invention is not limited to the abovementioned embodiments, that is, includes various kinds of modifications.

Figure 10:
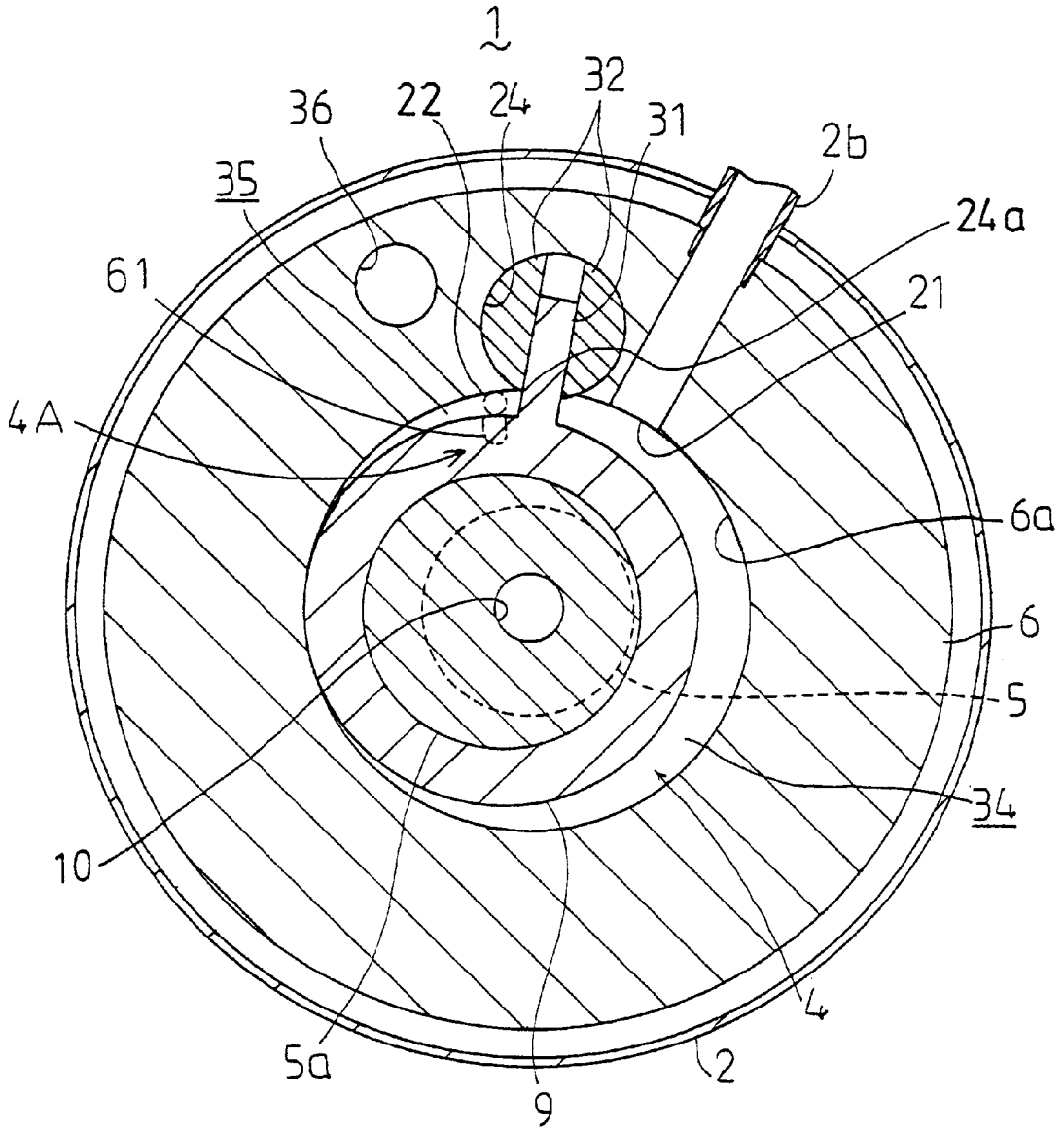
FIG. 10 is a view which shows another embodiment of the present invention and corresponds to FIG. 3.

For example, as shown in FIG. 10, each of the discharge ports (22) may be disposed at a position that does not overlap with the swing bush (32) and the cylinder (6) and in the proximity of the blade (31), so as to communicate with the high pressure room (35). In this case, as in the second embodiment, the cut parts (61) are each formed by cutting away an outer peripheral edge of the piston (9) which corresponds to an overlapped portion of the discharge port (22) with the piston (9).

In the third embodiment, the cut parts (71) are each formed across the swing bush (32), the cylinder (6) and the piston (9). However, in the case that an overlapped portion of the discharge port (22) with the cylinder (6) occupies a larger part of the entire overlapped portion as in the above-mentioned modification of the first embodiment, a pair of upper and lower cut parts are alternatively formed by cutting away the cylinder (6) and the piston (9) in the shape of a cone.

In the above-mentioned embodiments, the discharge ports (22) are formed in the front head (7) and the rear head (8) respectively. Alternatively, the discharge port may be formed only in the front head (7) or only in the rear head (8).

INDUSTRIAL APPLICABILITY

As mentioned so far, the rotary compressor according to the present invention is useful for a compressor in which a piston and a blade are integrally formed.

We claim:

1. A rotary compressor comprising:

a cylinder (6) in which a cylinder room (6*a*) is formed;

side housings (7, 8) respectively disposed on both side surfaces in an axial direction of the cylinder (6) to close the cylinder room (6*a*);

an annular piston (9) which is disposed in the cylinder room (6*a*) and is connected to the driving shaft (5) the annular piston being decentered from the central axis of the driving shaft (5);

a blade (31) which is formed integrally with the piston (9) and protrudes from the outer periphery of the piston (9) to divide the cylinder room (6*a*) into a low pressure room (34) communicating with an inlet port (21) and a high pressure room communicating with a discharge port (22); and a swing bush (32) which is swingably disposed in a support hole (24) formed in the cylinder (6) and supports the blade (31) so that the blade (31) is swingable and movable forward and backward, rotation of the driving shaft (5) causing revolution of the piston (9) around the driving shaft (5) in the cylinder room (6*a*) through the blade (31) thereby compressing a fluid in the cylinder room (6*a*), the discharge port (22) being formed in at least one of the side housings (7) and disposed to be located in the proximity of the blade (31) and to communicate with the high pressure room (35), said rotary compressor further comprising in the cylinder for guiding a high-pressure fluid in the high pressure room (35) to the discharge port (22).

2. A rotary compressor according to claim 1, wherein the discharge port (22) is disposed to partially overlap with the cylinder (6) and the swing bush (32), and the guide part (4A) is composed of a cut part (41) formed by cutting away an inner peripheral edge of the cylinder (6) and an outer peripheral edge of the swing bush (32) which are overlapped with the discharge port (22).

3. A rotary compressor according to claim 1, wherein the discharge port (22) is disposed to partially overlap with the cylinder (6) and the swing bush (32), and the guide part (4A) is composed of a cut part (51) formed by cutting away only an inner peripheral edge of the cylinder (6) with which the discharge port (22) overlaps.

4. A rotary compressor according to claim 1, wherein the discharge port (22) is disposed to at least partially overlap with the piston (9) on the way of revolution of the piston (9), and the guide part (4A) is composed of a cut part (61) formed by cutting away an outer peripheral edge of the piston (9) which corresponds to an overlapped portion of the discharge port (22) with the piston (9).

5. A rotary compressor according to claim 1, wherein the discharge port (22) is disposed to overlap at one part with the cylinder (6) and the swing bush (32) and to overlap at another part with the piston (9) on the way of revolution of the piston (9), and the guide part (4A) is composed of a cut part (71) formed by cutting away an inner peripheral edge of the cylinder (6) and an outer peripheral edge of the swing bush (32) which are overlapped with the discharge port (22) and cutting away an outer peripheral edge of the piston (9) which corresponds to an overlapped portion of the discharge port (22) with the piston (9).

* * * * *

UNITED STATES PATENT AND TRADEMARK OFFICE

CERTIFICATE OF CORRECTION

PATENT NO. : 6,077,058

DATED : June 20, 2000

INVENTOR(S) : Kenichi Saitou, et. al.

It is certified that error appears in the above-identified patent and that said Letters Patent is hereby corrected as shown below:

Claim 1, line 28, after "in the cylinder" please insert –a guide part (4A)--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*